United States Patent [19]

Orlando, Jr.

[11] Patent Number: 4,711,510

[45] Date of Patent: Dec. 8, 1987

[54] ELECTRICAL CONNECTOR FOR TRACTOR-TRAILER RIG

[76] Inventor: Alfred J. Orlando, Jr., 32 Carl Rd., Walpole, Mass. 02081

[21] Appl. No.: 863,924

[22] Filed: May 15, 1986

[51] Int. Cl.[4] ..... H01R 13/625

[52] U.S. Cl. ..... 439/246; 439/294; 439/339; 439/838

[58] Field of Search ..... 339/10, 46, 47 R, 47 C, 339/48, 49 R, 49 B, 64 R, 64 M, 88 R, 255 R, 108 TP

[56] References Cited

U.S. PATENT DOCUMENTS

| | | | |
|---|---|---|---|
| 359,982 | 3/1887 | Plume | 339/49 B |
| 1,010,173 | 11/1911 | Pierce et al. | 200/24 |
| 1,651,314 | 11/1927 | Beasley, Jr. | 339/108 TP |
| 2,520,681 | 8/1950 | Hanson, Jr. | 200/161 |
| 3,378,810 | 4/1968 | Dorrell | 339/255 R |
| 3,984,808 | 10/1976 | Laz et al. | 340/58 |
| 4,418,946 | 12/1983 | Gambon | 339/49 B |

FOREIGN PATENT DOCUMENTS

| | | | |
|---|---|---|---|
| 20367 | of 1891 | United Kingdom | 339/47 C |

*Primary Examiner*—John McQuade

[57] ABSTRACT

A multiwire electrical connector for making electrical connections between the tractor and trailer of a tractor-trailer rig. The connector has two members, each with a set of mating connector elements (e.g., spherical balls and mating spherical recesses). A flange-locking means is provided for locking the two connector members together; one member is pressed against the other along an axial direction, and the members are rotated relative to one another until radially-extending flanges engage flange receptacles. Spring means in at least one member urge the mating connector elements tightly against each other along the axial direction, to assure continuous electrical contact between the connector elements. The spring means also cooperates with the flange-locking means to provide resistance to axial compression of the members toward one another, thereby providing tight, vibration-resistant engagement of the locking flanges and flange receptacles.

7 Claims, 7 Drawing Figures

FIG 1
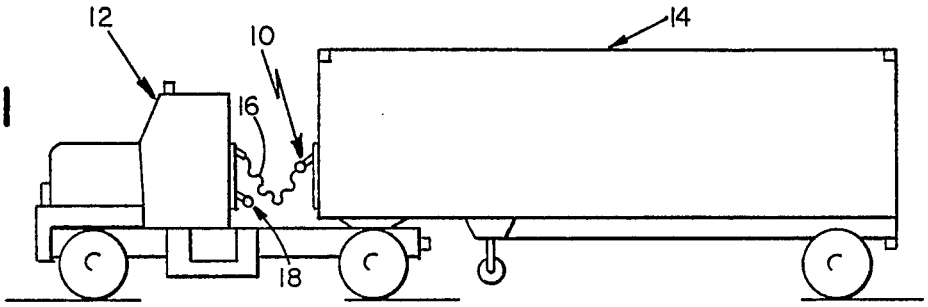
FIG 2
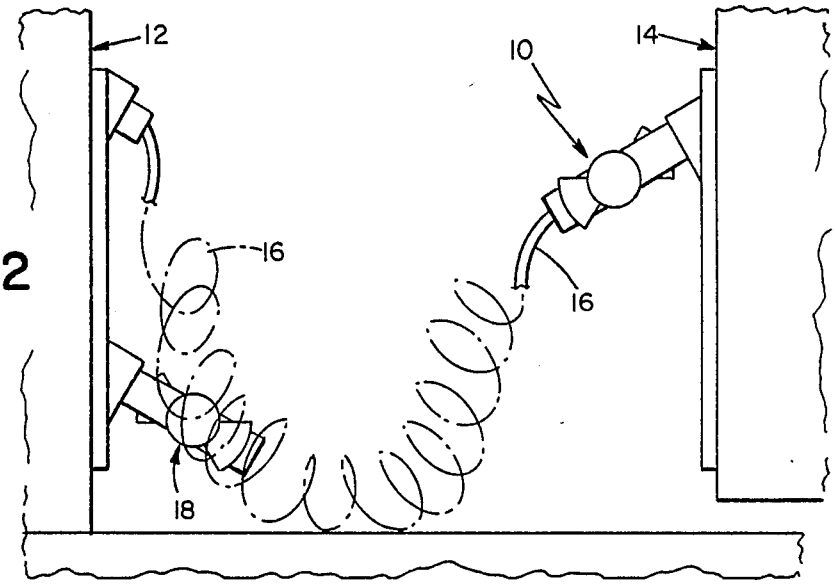
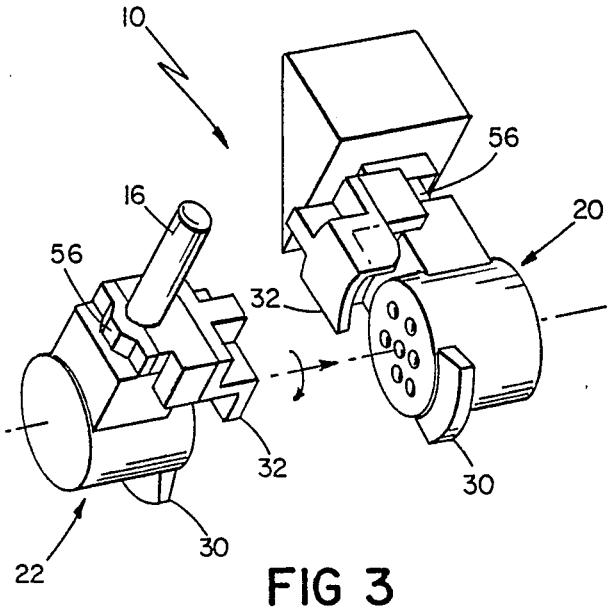
FIG 3
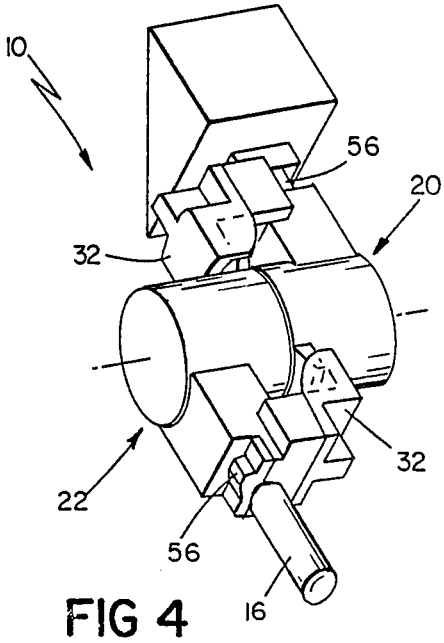
FIG 4

ELECTRICAL CONNECTOR FOR TRACTOR-TRAILER RIG

BACKGROUND OF THE INVENTION

The invention relates to connectors for making electrical lighting connections between the tractor and trailer of a tractor-trailer rig. The lights of a trailer are powered and operated from the tractor via a multiwire cable (typically seven wires) strung from the back of the tractor cab to the front of the trailer. Typically, a seven-receptacle female connector on the end of a cable extending from the tractor cab is connected to a mating seven-prong male connector mounted on the face of the trailer. When new and functioning properly, the prongs and receptacles of this conventional socket connector engage in a tight frictional fit. But over time, the prongs and receptacles wear and corrode, producing faulty connections and inoperative lighting.

SUMMARY OF THE INVENTION

In general the invention features a multiwire electrical connector for making electrical connections between the tractor and trailer of a tractor-trailer rig. The connector has two interlocking members (which might also be referred to as male and female connectors). Each member has a set of mating connector elements (e.g., spherical balls and mating spherical recesses). A flange-locking means is provided for locking the two connector members together; one member is pressed against the other along an axial direction, and the members are rotated relative to one another until radially-extending flanges engage flange receptacles. Spring means in at least one member urge the mating connector elements tightly against each other along the axial direction, to assure continuous electrical contact between the connector elements. The spring means also cooperates with the flange-locking means to provide resistance to axial compression of the members toward one another, thereby providing tight, vibration-resistant engagement of the locking flanges and flange receptacles.

In preferred embodiments, a plurality of individual springs (e.g., helical compression springs) each resist inward movement of a single connector element; spherical balls form one set of connector elements and are supported in holes tapered to a smaller diameter at the face of the member to provide a stop against outward axial movement; the radially-extending flanges or flange receptacles include an inclined surface (inclined along the circumferential direction) to provide a means of compressing the members against one another when rotated into the locked position; a detent is provided between the flanges and flange receptacles for locking the members in the locked position; the connector elements are installed in insert members, which are in turn installed in recesses in the members, to simplify installation and repair of electrical connections; a seal is positioned around the periphery of at least one member and adapted to seal the space between the members when they are in the locked position, to keep moisture and debris from reaching the connector elements.

The invention provides a much-improved connector for making connections between a tractor and trailer. The connector is resistant to failures from vibration and corrosion, can be made weatherproof using a seal, is quickly and easily connected and disconnected, can easily be maintained, works reliably for much longer periods (without the wear and loosening of prior devices), can be arranged to disconnect without harm to connector or cable in the event of trailer drop or premature tractor pull. These benefits mean increased operational safety; loss of lights or blinking from poor connections are eliminated, meaning fewer accidents and highway fines. The greater reliability and longer lift of the connector greatly reduces truck maintenance costs.

Other features and advantages of the invention will be apparent from the following description of the preferred embodiments and from the claims.

DESCRIPTION OF THE PREFERRED EMBODIMENTS

FIG. 1 is an elevation view of a tractor-trailer with the connector of the invention.

FIG. 2 is an enlarged and more detailed view of a portion of FIG. 1.

FIG. 3 is perspective view of the connector, with its two members positioned ready for locking together.

FIG. 4 is a perspective view of the connector in the locked position.

Figure 5:
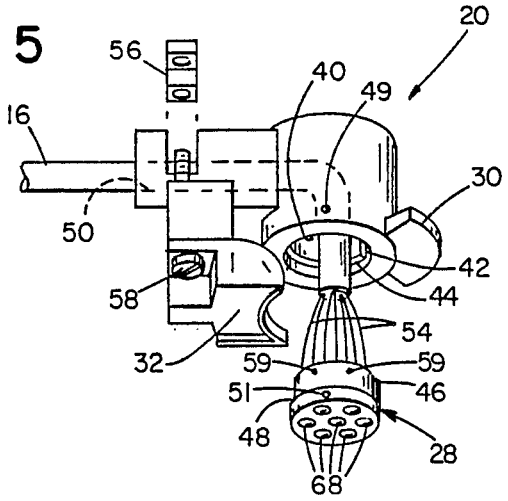
FIG. 5 is a perspective view of one member of the connector partially disassembled.

Referring to FIGS. 1 and 2, electrical power for lighting trailer 14 passes from tractor 12 to the trailer via multiwire cable 16 and connector 10. when not connected to a trailer, the tractor portion of connector 10 is stored by connecting it to dummy connector member 18 provided on the tractor.

Referring to FIG. 3, connector 10 consists of two members 20, 22, one connected to tractor cable 16 and the other connected to a cable within the trailer (also referred to by reference numeral 16, but not shown in FIGS. 1–3). The members are constructed of an opaque Lexan or equivalent thermoplastic material. Each member 20, 22 has an integral radially-extending flange 30 and flange receptacle 32 (stamped steel with corrosion-inhibiting coating), which is attached to the member with screws (not shown), and which serves to align and lock together the two connector members.

Figure 6:
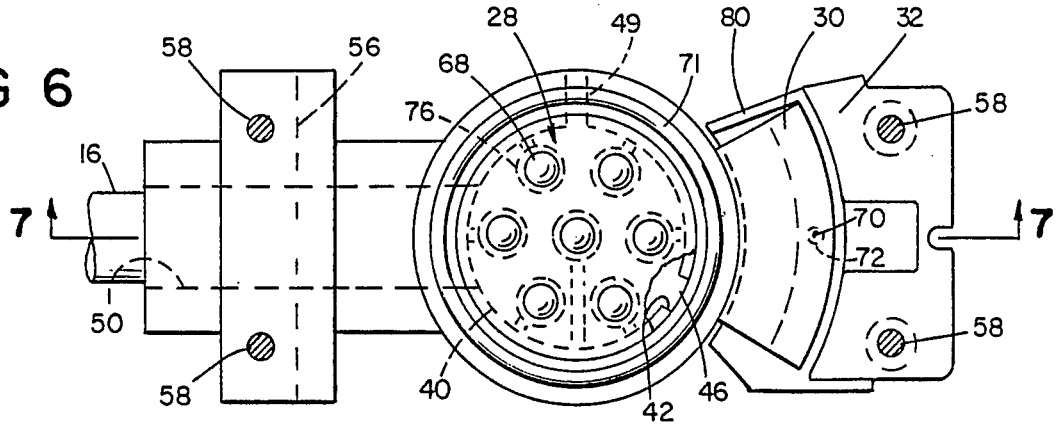
FIG. 6 is a view taken along 6—6 in FIG. 7, showing one connector member in the locked position.
Figure 7:
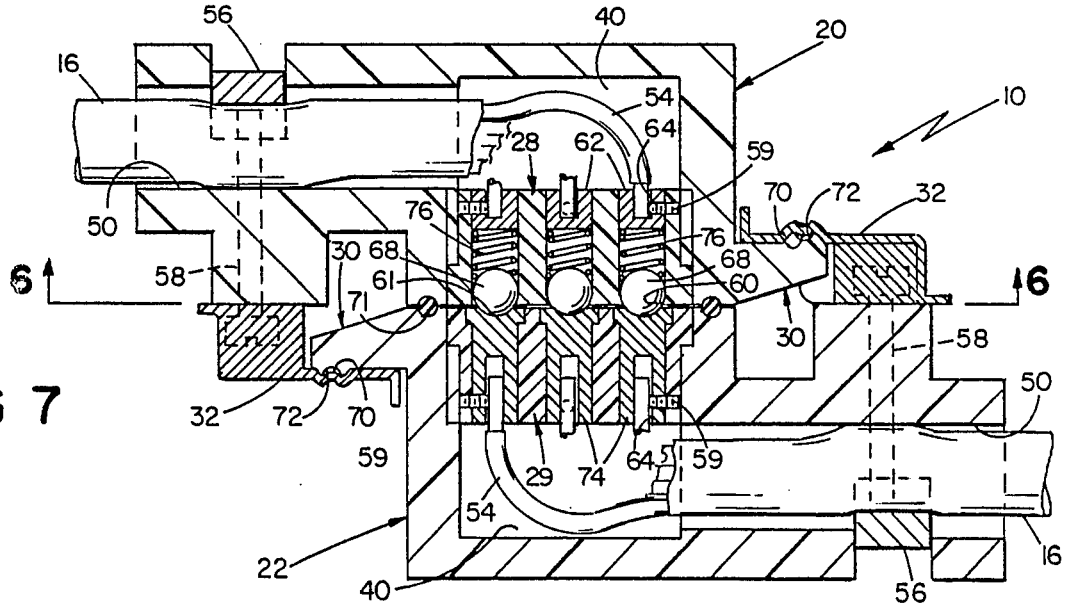
FIG. 7 is a cross-sectional view taken along 7—7 in FIG. 6, showing both connector members in the locked position.

Referring to FIGS. 5–7, each member has a cylindrical cavity 40 which receives cylindrical insert 28 in which the connector elements are supported. Key way 42 in cylindrical cavity 40 receives key 46 to insert 28 to provide angular orientation. Annular ledge 44 and lip 48 insure that the inserts 28 are installed with their exposed surfaces flush with the surrounding surfaces of the members. Inserts 28 are held in position by a screw installed in apertures 49, 51 (FIG. 5).

Cable 16 enters the connector member through aperture 50, which leads to cavity 40 in which the insert 28 resides. The cable is held in position by clamp 56 installed using screws 58. Individual wires 54 from the cable are electrically connected to individual connector elements, by inserting the wires into holes 64 in elements 62, 74 (brass), and tightening screws 59. Elements 62, 74 are knurled to effect a tight fit in insert 28.

Connector member 20 has spherical balls 68 (stainless steel) forming convex connector elements. The spherical balls are retained ininsert 28 by the tapering of holes 60 at the exposed face of insert 28. Helical, compression springs 76 between the spherical balls and elements 74 provide an outward preload on each of the spherical balls. Connector member 22 has elements 74 with mating spherical recesses 61 forming convex connector elements.

Sealing ring 71 is provided on the surface of member 22 (FIG. 6) to provide a seal against moisture and debris entering the area of electrical contact.

Flanges 30 are held in the locked position engaged with flange receptacles 32 by a detent arrangement consisting of protrusion 70 in the flange and mating recess 72 in the flange receptacle.

In use the connector members are connected and locked together by orienting them at 90° orientation, as shown in FIG. 3, pressing the two connectors together along the axial direction, and rotating member 22 relative to member 20 until flanges 30 lock into flange receptacles 32. Stop 80 formed in the flange receptacles (FIG. 6) prevents over rotation of the two members. The detent formed by protrusion 70 and recess 72 lock the two members in the desired angular orientation, at which the spherical balls 68 and spherical recesses are properly indexed.

Springs 76 resist axial comprssion of the two members againt each other. The springs serve dual purposes, they provide tight, vibration-resistant engagement of flanges 30 and flange receptacles 32 and continuous, vibration-resistant electrical contact between spherical balls 68 and mating spherical recesses 61. As the two members rotate through 90° into the locked position, spherical balls 68 ride into and out of one other spherical recess 61 before reaching their mating spherical recess in the locked position.

One of the connector members is mounted to the trailer at approximately a 45° downward inclination, as shown in FIG. 2. This provides a downwardly-angled orientation of the two connectors in their locked position, as shown in FIG. 2, and thereby serves as a means of automatically disconnecting the two connector members should the driver forget to disconnect the connector before driving the tractor away from the trailer, or if the trailer drops for some other reason. In those events, the force applied to the connection by cable 16 will be at such an angle as to tend to rotate the connector members out of the locked, detented position, so that they will separate from one another without harm to the connector or cable.

Other embodiments of the invention are within the following claims.

I claim:

1. A multiwire electrical connector for making electrical connections, said connector comprising:

a first member with three or more first connector elements, said elements being distributed across a planar first connector face, a second member with three or more second connector elements, said elements being distributed across a planar second connector face in a pattern matching that of said first connector elements, said first connector elements being convex and second connector elements being concave and shaped to mate with said first elements, so as to ensure mating alignment of said first and second elements when said members are in a locked position, flange-locking means for locking said members together in said locked position, comprising on each member a flange extending radially of an axis normal to said planar connector face, a flange receptacle for engaging said flange of the other member when said members are pressed together along said axis and rotated relatively to one another about said axis, and mating detent protrusions in said flanges and flange receptacles, said detent protrusions engaging in said locked position.

individual springs, at least one for each mating pair of first and second connector elements, each said spring being adapted to resist inward movement of its associated connector element into its associated member, said springs providing an axial locking force that with said detent protrusions ensures that said members remain in said locked position and individual mating forces on each mating pair of connector elements to ensure good electrical contact between each mating pair.

2. The connector of claim 1 wherein said springs are adapted to carry the electrical current passing through their associated connector element.

3. The connector of claim 1 wherein said springs are helical compression springs and are installed in said first member to resist inward movement of said convex connector elements into said first member.

4. The connector of claim 1 wherein said convex elements are spherical balls, said concave element shaving mating spherical recesses, and said spring means comprises individual springs resisting inward movement of said spherical balls into said first member.

5. The connector of claim 4 wherein said spherical balls are supported within holes tapered to a smaller diameter at the face of said first member, said tapered holes thereby forming a stop against outward axial movement of said balls.

6. The connector of claim 1 wherein said concave and convex connector elements are mounted in insert members, and said insert members are installed in recesses in said members, so that said insert members can be removed for installation or repair of electrical connections to said elements.

7. The connector of claim 1 further comprising a seal on at least one of said members, said seal being positioned around the periphery of said member and adapted to seal the space between said members in said locked position to keep moisture and debris from reaching said connector elements.

* * * * *